United States Patent [19]

Everman et al.

[11] Patent Number: 4,649,689

[45] Date of Patent: Mar. 17, 1987

[54] INSULATION FASTENER SYSTEM

[76] Inventors: Wilburn D. Everman, 1110 N. Lyne, Belton, Mo. 64083; Lee R. Epley, 12410 Monroe, Grandview, Mo. 64030

[21] Appl. No.: 607,691

[22] Filed: May 7, 1984

[51] Int. Cl.[4] ..... E04B 1/38

[52] U.S. Cl. ..... 52/701; 52/359; 52/361; 52/489

[58] Field of Search ..... 52/698, 699, 705, 408, 52/410, DIG. 6, 357, 359, 360, 361, 489, 700, 701, 309.8, 506, 512, 404, 483, 765; 24/453, 625, 295

[56] References Cited

U.S. PATENT DOCUMENTS

| | | | |
|---|---|---|---|
| 2,282,631 | 5/1942 | Winship | 52/361 X |
| 2,995,784 | 8/1961 | Driscoll | 52/416 |
| 3,090,203 | 5/1963 | Durget | 52/698 X |
| 3,276,180 | 10/1966 | Westinghouse | 52/489 |
| 4,161,087 | 7/1979 | Levesque | 52/62 |
| 4,288,951 | 9/1981 | Carlson et al. | 52/3 X |

FOREIGN PATENT DOCUMENTS

| | | | |
|---|---|---|---|
| 863804 | 4/1941 | France | 52/22 |

OTHER PUBLICATIONS

Celotex, Energy-Saving Thermax Grid Suspension System brochure; The Celotex Corporation.

PEBS Guidebook; Johns-Manville.

Insul-Grid Roof Insulation Systems brochure; Mizell Bros. Co.

The Energy Miser System brochure; Owens/Corning Fiberglass.

Celotex Energy Saving Insulation Systems for Agricultural Buildings brochure; The Celotex Corporation.

Spec-Data MI-T-R Roof Insulation System brochure; Mizell Bros. Co.

*Primary Examiner*—William F. Pate, III

*Assistant Examiner*—Naoke N. Slack

*Attorney, Agent, or Firm*—D. A. N. Chase; Michael Yakimo, Jr.

[57] ABSTRACT

An insulation system utilizes a plurality of insulation fasteners to support an insulation board or the like adjacent the roof-supporting framework/purlins of a building. Each fastener comprises a clip member with projecting shank with the former engageable with a projecting flange of the purlin. Upon extension of the shank through or across an edge of an insulation board placed adjacent the building purlins, an underlying support washer is engageable with the shank so as to sandwich a portion of the insulation board or adjacent edges of adjacent boards therebetween. A plurality of insulation fasteners are used with each insulation board so as to support a plurality of insulation boards and overlying batt insulation adjacent the purlins and roof of the building.

26 Claims, 6 Drawing Figures

INSULATION FASTENER SYSTEM

BACKGROUND OF THE INVENTION

This invention relates to the field of insulation systems and, more particularly, to mechanical fasteners used therein for supporting an insulation system having a positive vapor barrier from the roof-supporting framework of a building.

Metal buildings comprising a framing system and panels are currently found in a wide range of uses. Being readily available and easily erected they have been integrated with a wide range of architectural materials to present relatively inexpensive and aesthetic structures.

Rising energy costs require building designers and owners to employ more efficient insulation systems in such buildings so as to reduce rapidly rising operating costs. Thus, various insulation products have been specifically designed for use with metal buildings including insulation systems for insulating the roof of metal buildings. Such insulation systems are designed for installation in buildings during initial construction as well as for retrofit installation in standing buildings. In roof insulation systems, it is desirable to position the insulation adjacent the roof sheathing while presenting to the building occupant an aesthetically pleasing appearance.

Past insulation systems include the use of interlocking support channels which are suspended from brackets attached to the roof framing members or purlins. The channel array in turn supports the fiberglass insulation adjacent the roof and between the roof-supporting purlins.

Other systems include the use of a framework which is suspended from the purlins of the building by means of wires or the like. This framework in turn supports fiberglass insulation boards thereon. Fiberglass blanket insulation is placed atop these boards and adjacent the roof sheathing.

Another system utilizes a plurality of clip members which are attached along the length of the purlin. An elongated extrusion member is attached to the bottom of each clip member in extension along the length of the metal purlin. Once affixed, fiberglass insulation boards are supported between parallel extrusion members and below the metal purlins. The insulation boards in turn support fiberglass insulation batts thereon.

Another system utilizes a plurality of clip members attached along the length of the purlins which engages a roller tube extending below and along the length of each individual purlin. Flexible insulation is then drawn through the gap between the purlin and the associated roller tube so that the roller tube offers underlying support to the overlying insulation.

Although the above systems are assumably effective in their operation, it is desirable to present a system having a positive vapor barrier and a minimal number of parts therein which are easily engageable with the building's purlins and effectively engage and support the insulation adjacent the purlins and the roof of the building. In response thereto, we have invented an insulation system which utilizes a novel fastener device comprising clip and support washer elements. The clip is releasably engageable with the lower longitudinal flange of each purlin and presents a depending shank which is positively engageable with an aperture in the underlying washer. The washer has purchase elements thereon, in the form of upstanding teeth, which are engageable with the facing side of the utilized insulation such as insulation boards or the like. The configurations of the washer and shank provides a positive engagement therebetween so as to effectively support the portion of a fiberglass insulation board sandwiched therebetween. A plurality of fastener devices is associated with each insulation board so as to support the same adjacent the purlins as well as to enable fiberglass insulation to be placed thereon. Each underlying washer and joints between the adjoining insulation boards are taped so as to present an insulation system having a positive vapor barrier. Our novel fastener device is easily installed, eliminates the need for the suspension of framework along and/or between the purlins and presents an insulation system having a positive vapor barrier. Thus, installation and labor costs of our system are reduced while still presenting an aesthetically pleasing appearance to the building occupant.

It is therefore a general object of the invention to provide an insulation system presenting a positive vapor barrier and designed for use with the roof-supporting framework of a building.

Another general object of this invention is to provide an insulation system, as aforesaid, utilizing novel fastener devices therein which positively engage and support insulation adjacent the roof of a building.

Another object of this invention is to provide an insulation system with fastener devices, as aforesaid, which includes a clip element having a depending shank positively engageable with a support washer therebelow so as to offer support to an insulation board a portion of which is sandwiched therebetween.

Another object of this invention is to provide an insulation fastener system, as aforesaid, which eliminates the need for framework hung below and/or between the supporting framework of the building.

Another object of this invention is to provide an insulation system, as aforesaid, which is easily installed with the use of only a lightweight hammer.

Other objects and advantages of this invention will become apparent from the following description taken in connection with the accompanying drawings, wherein is set forth by way of illustration and example, preferred and alternative embodiments of of this invention.

DESCRIPTION OF THE PREFERRED EMBODIMENTS

Figure 1:
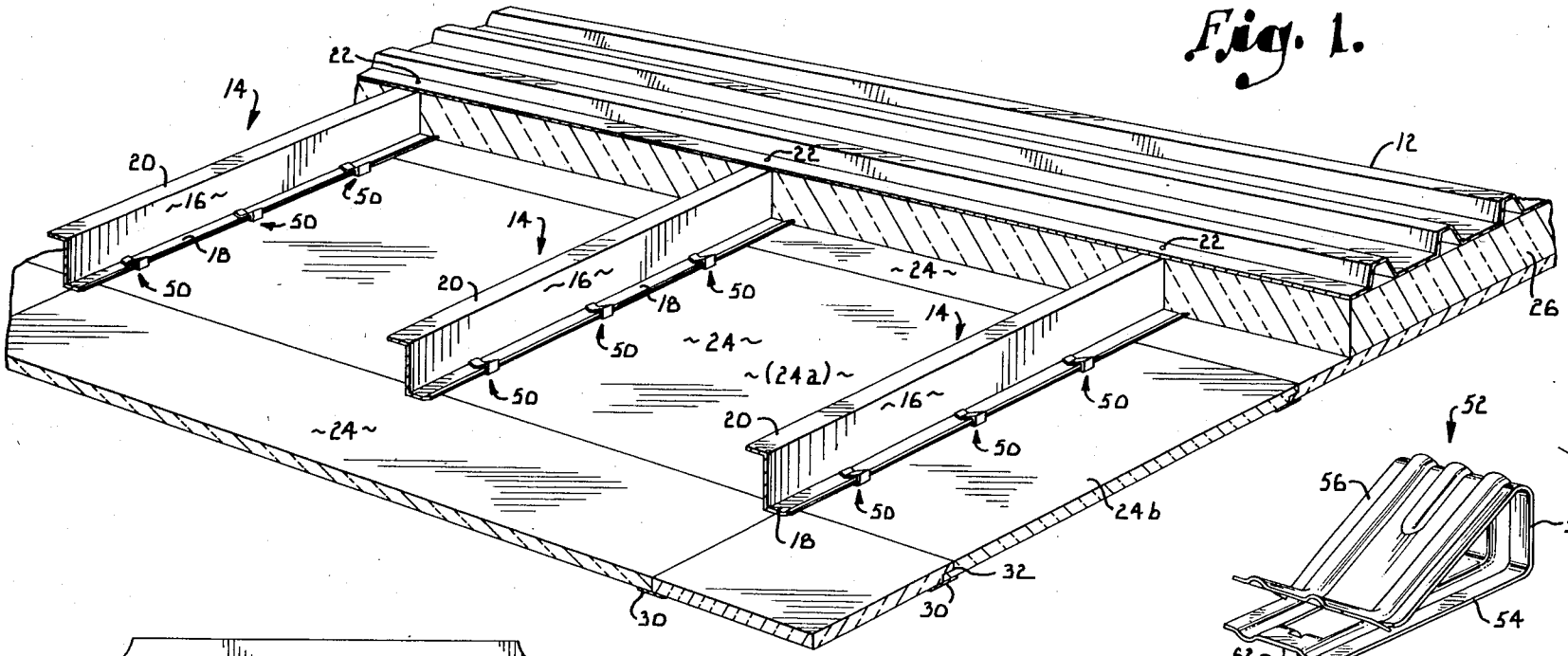
FIG. 1 is a fragmentary view of a portion of the insulation system adjacent a portion of the roof of a building.

Turning more particularly to the drawings, FIG. 1 illustrates a portion of my insulation system 10 in place adjacent the roof 12 of a metal building. Underlying the roof sheathing 12 is a plurality of roof-supporting braces 14 or purlins. Each purlin 14 has a web face 16 spanning lower 18 and upper 20 flanges normally projecting from the web 18. The upper flange 20 of each purlin 14 is fastened to the sheathing 12 by means of bolts, nuts or the like as shown at 22. Along the extent of the lower flange 18 of each purlin 14 are attached a plurality of insulation fasteners 50 as to be subsequently described. Each insulation fastener engages a portion of a fiberglass insulation board generally designated as 24. Each rectangular board 24 is generally 4'×10' in configuration although other sizes may be utilized. As the purlins 14 are conventionally spaced 5 feet apart, three purlins 14 are shown associated with one 4'×10' insulation board 24.

Once the fiberglass board 24 is positioned below the purlins 14 by the fasteners 50, fiberglass blanket insulation 26 or the like is positioned above each board 24, as shown atop board 24*a*, and between the adjacent purlins 24. The fiberglass boards 24 have ship and lap joints 32 providing for a flush fit between adjacent boards. The resulting joints 25 are covered with a vapor tape 30 to preclude passage of moisture therethrough and to conceal the joints from the building occupant.

Figure 2:
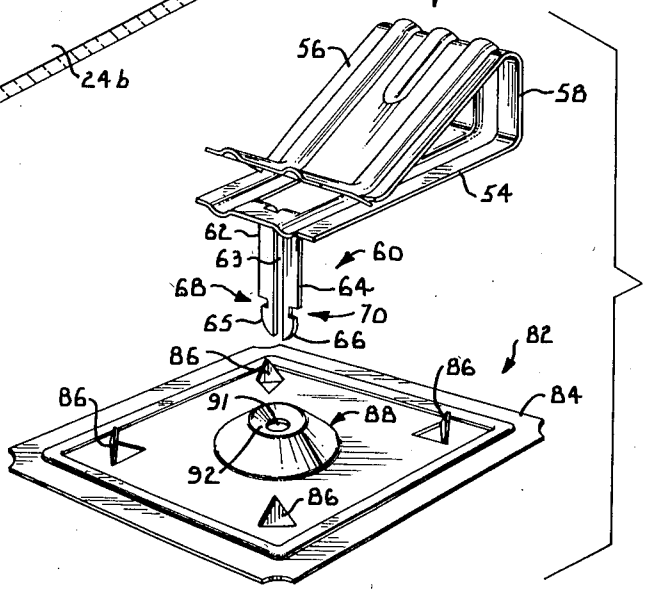
FIG. 2 is a perspective exploded view of the clip and support washer members of each insulation fastener device utilized in the system of FIG. 1.
Figure 3:
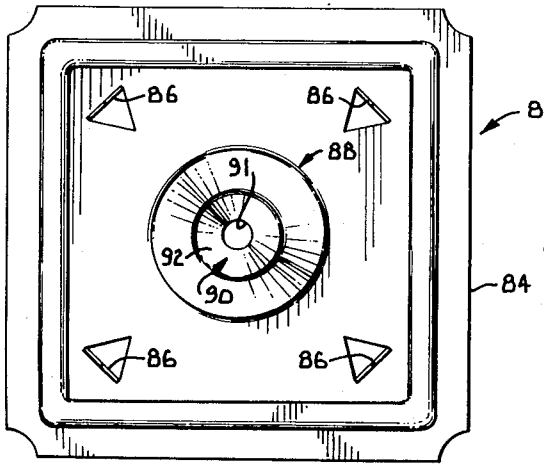
FIG. 3 is a plan view, approximating a full scale, of the support washer of each insulation fastener.
Figure 4:
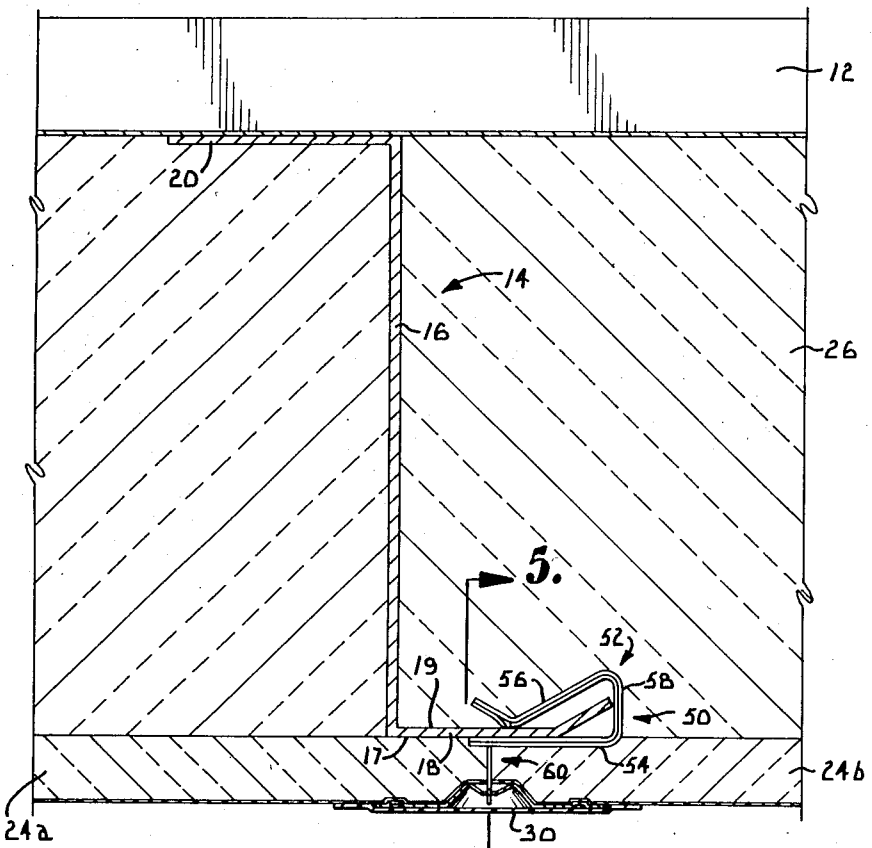
FIG. 4 is a sectional end view, taken along a building purlin and on an enlarged scale, showing the engaged clip and washer elements with the edges of abutting fiberglass boards sandwiched therebetween and blanket insulation supported thereon.

Each insulation fastener 52 comprises a clip member 52 and a washer member 82 as shown in FIG. 2. The clip 52 comprises a generally planar base plate 54 and an overlying clamping plate 56 as separated by an intermediate web 58. Clamping plate 56 has been configured to present a downward bias toward the base plate 54. Clip 52 is preferably made of a yieldable metal, such as spring steel or the like, so as to be yieldably responsive to insertion of the lower flange 18 of the purlin between the base plate 54 and clamping plate 56 of each clip 52. Upon clip 52 engagement with the lower flange 18, the base plate 54 lies generally flush with the underlying surface 17 of the flange 18 with the clamping plate bearing on the opposed surface 19 of flange 18 as shown in FIG. 4.

Depending from the base plate 54 is an elongated, bifurcated shank 60 comprising first 62 and second 64 laterally-spaced apart prong elements presenting a gap 63 therebetween. Each prong 62, 64 is preferably made of a resilient material, such as spring steel or the like, to allow for movement of the prongs 62, 64 one towards another and closure of the gap 63 upon compressive forces acting thereon. Notches 68 and 70 are found adjacent the tapered ends 65, 66 of each prong 62, 64 for a purpose to be subsequently described. Each notch 68, 70 presents an upper wall 68*a*, 70*a* and a lower wall 68*b*, 70*b* relative to the tapered free ends 65, 66 of each prong 62, 64. As shown in FIG. 4, the shank 60 normally depends from the purlin 14, relative to the lower mounting flange 18, upon engagement of the clip member 52 with the purlin 14.

The underlying support washer 82 comprises a generally square, planar base plate 84. Upwardly extending from the base plate 84, at the corners thereof, are a plurality of teeth 86 normally positioned relative to the diagonals of the base plate 84. Centrally positioned on the base plate 84 is an upstanding cone 88 having a central aperture 90 therein. Aperture 90 is recessed relative to the apex 89 of the cone 88 which presents a canted surface 92 downwardly extending between the apex of the cone 88 and aperture 90.

In use, a plurality of clips 52 is attached along the length of a respective purlin 14 as shown in FIG. 1. The engagement of each clip 52 with the lower mounting flange 18 of the purlin 14, is as above-described, presents a plurality of bifurcated shanks 60 projecting from a respective purlin 14. The insulation board 24 is then placed adjacent the purlin 14 so that each shank 60 either penetrates or either extends across the edge of the insulation board 24 as best shown in FIG. 5.

Subsequently the support washer 82 engages the respective shank 60 by inserting the free end 66 of the shank 60 through the central aperture 90. It is here noted that the diameter of the central aperture 90 is less than the width of the shank 60 as presented by the two parallel prongs 62, 64 and gap 63 therebetween. The tapered ends 65, 66 of each prong 62, 64, along with the canted surface 92, facilitate initial guidance and penetration of the shank 60 through this aperture 90. Contact of the tapered ends 65, 66 with the canted surface 92 and rim 91 of aperture 90 compresses prongs 62, 64 one towards the other. This compression closes the gap 63 and reduces the effective width of the shank 60 to a diameter less than the central aperture 90 allowing for initial penetration therethrough. As the surface 92 surrounding the aperture 90 is downwardly canted, the upper walls 68*a*, 70*a* of the respective notches 68, 70 engage this surrounding surface 92 with the rim 91 of aperture engaging the lower walls 68*b*, 70*b* of the notches 68, 70. Upon reception of portions of the surface 92 in the respective notches 68, 70, the prongs 62, 64 return to their normal position which precludes movement of the surface 92 out of the notches 68, 70. Accordingly, the notches 68, 70 and washer 82 are precluded from further relative longitudinal movement which positively maintains the shank 60 in place. The upstanding cone 88 contains the portion of shank 60 projecting through the aperture 90 which precludes projection of the shank 60 beyond the base plate 84 and the vapor barrier tape 30 which subsequently covers each washer 82. Concurrent with such engagement, the respective teeth 86 of the washer 82 penetrate the facing side of overlying insulation board 24 as shown in FIGS. 5 and 6. This engagement precludes movement of the underlying washer 82 about the shank 60. Furthermore, it is preferred that these teeth lie normal to the diagonals of the base plate 84 to preclude any incidental movement of the washer 82 about the shank 60 which may occur during building sway or the like.

Upon the above-described engagement, a portion of the insulation board(s) 24 is sandwiched between the clip member 52 and support washer 82. Each sandwiched portion is held adjacent the lower flange 18 of the particular purlin 14 by the particular clip 52/support washer 82 combination. Upon engagement of a plurality of insulation fasteners 50 (9 as shown) with the purlins 14 and portions of the insulation board(s) 24, the entire board 24 is held in place adjacent the particular purlin array. Fiberglass batt insulation 26 may then be supported thereon as illustrated in the drawings.

Figure 5:
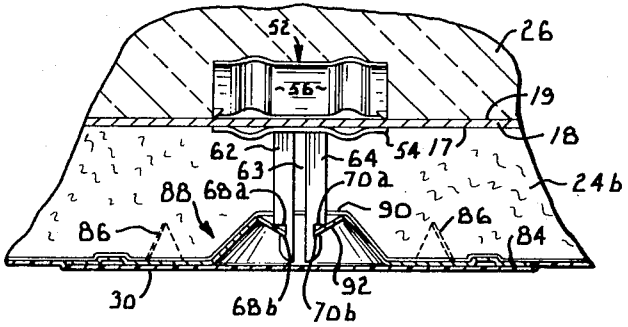
FIG. 5 is a sectional elevation view, taken along line 5—5 in FIG. 4, showing the engagement of the shank with the underlying support washer.
Figure 6:
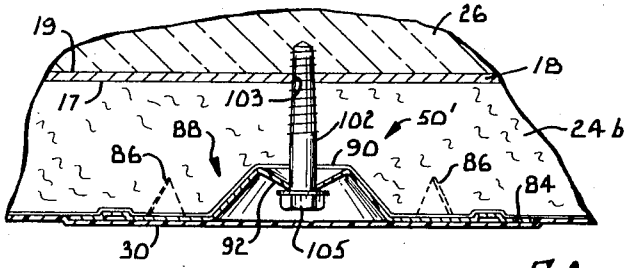
FIG. 6 is a sectional view, similar to that in FIG. 5, and showing an alternative embodiment of the insulation fastener in FIG. 2.

It is herein noted that the shank 60 of certain insulation fasteners 52 will extend across the edges of abutting insulation boards 24*a*, 24*b* as shown in FIGS. 4, 5 rather than penetrate the board proper. Such shanks 60 penetrate the joint between abutting boards 24*a*, 24*b*. The associated support washer 82 spans this joint so that two adjacent teeth 86 penetrate the face of each board 24*a*, 24*b* as shown in FIGS. 4, 5. Accordingly, a portion of each insulation board 24*a*, 24*b* is sandwiched between the clip 52 and washer 82. Subsequently, each joint and the spanning and non-spanning washers 82 are covered with a vapor tape 30 to preclude permeation of moisture through the joints and/or washer.

An alternative embodiment 50' of the insulation fastener is shown in FIG. 6. The shank 60 of the above-described insulation fastener 50 is presented by a screw member 102. Apertures 103 are drilled along the length of the lower flange 18 of each purlin. The insulation board 24 is placed adjacent the flanges 18 of the purlin array and the washer 82 is then engaged with the facing side of insulation board 24. Upon engagement, the screw portion is extended across the insulation board 24 and functionally engages the aperture in the flange 18. Head 105 is larger than the aperture 90 in washer 82 so as to preclude slippage of the threaded shank 102 therethrough. Again, a portion of the insulation board 24 is sandwiched between the washer 82 and the lower surface 17 of the flange 18 with an array (nine) of such fasteners 50' positively supporting the insulation board 24 adjacent the purlins 14.

In installation of our insulation system 10, a plurality of fasteners 52 and insulation boards 24 are utilized. Each board 24 is attached, as above-described, with the plurality of boards being placed in adjoining relationships so as to cover the purlins 14. Upon covering, the resulting joints between adjoining boards 24 and washers 82 with the vapor barrier tape 30, a positive vapor barrier system is presented. This system can achieve a rating of 0.020 perms said value being an industry term indicating the number of grains of water passing through a septum in a given amount of time.

It is to be understood that while certain forms of this invention have been illustrated and described, it is not limited thereto, except in so far as such limitations are included in the following claims.

Having thus described the invention what is claimed as new and desired to be secured by Letters Patent is as follows:

1. An insulation fastener comprising:

a shank member comprising a pair of side-by-side prong elements positioned in a normal spaced-apart relationship therebetween;

means for attaching said shank member to a roof-supporting purlin in a manner to extend said shank away from said roof and across a portion of an insulation member placed adjacent said purlin;

a support washer having a shank receiving aperture therein, said support washer positioned adjacent a surface of said insulation opposite said purlin for insertion of a free end of said prongs of said shank in said aperture with said portion of said insulation supported by said washer from said purlin, said prong elements of said shank being yieldably responsive upon said insertion in a first direction to reduce said spaced-apart relationship and allow for said insertion of said prongs into said aperture;

means for connecting said shank to said support washer in a manner to maintain said washer in said supporting position and said insulation portion adjacent said purlin.

2. The apparatus as claimed in claim 1 wherein said attaching means comprises a clip member fastened to said shank and engaging a projecting surface of said purlin.

3. The apparatus as claimed in claim 1 wherein one end of said shank is threaded for functional engagement with an aperture in said purlin whereby to present said attaching means.

4. The apparatus as claimed in claim 1 wherein said connecting means comprises a notch in at least one of said prongs, said notch receiving a portion of a surface surrounding said aperture upon said insertion of said prongs into said aperture and upon said yieldable movement of said prongs in said first direction, said reception of said surface in said notch allowing for movement of said prongs in a second direction opposite said first direction and towards said normal spaced-apart relationship whereby to capture said surface in said notch and to preclude relative movement between said shank and said aperture.

5. The apparatus as claimed in claim 4 wherein said notch is configured to present upper and lower surfaces relative to said free end of said prong, said lower surface of said notch engaging the rim of said aperture with said upper surface engaging a portion of said surface surrounding said central aperture, whereby to wedge said surrounding surface in said notch to preclude relative movement between said shank and said aperture.

6. The apparatus as claimed in claim 4 wherein each of said prong members elements is tapered at the free end thereof to facilitate initial penetration of said prongs into said aperture.

7. The apparatus as claimed in claim 1 wherein said washer comprises:

a base plate;

a cone extending from said base plate and having said central aperture therein, said shank being received within said cone to preclude projection of said shank beyond said base plate of said washer.

8. The apparatus as claimed in claim 7 wherein said washer further comprises a plurality of upstanding teeth member projecting from said base plate with at least one of said teeth engaging said insulation whereby to preclude separation of said washer therefrom.

9. The apparatus as claimed in claim 1 wherein said attaching means comprises a clip member for gripping a flange extending from said purlin or the like.

10. The apparatus as claimed in claim 9 wherein said clip member comprises:

a base plate;

a clamping plate;

a web portion extending between said base plate and said clamping plate to displace said clamping plate from said base plate upon insertion of said flange therebetween whereby to clamp said clip member to said flange.

11. An insulation fastener comprising:

a shank member haying first and second ends;

a clip member fastened to the first end of said shank, said clip engaging a portion of a roof-supporting purlin in a manner to extend said shank away from said roof and across a portion of insulation placed adjacent said bottom of said purlin;

a support washer having a shank receiving aperture therein, said washer positioned adjacent a surface of said insulation opposite said roof to allow for insertion of said second end of said shank therethrough; and means for maintaining said shank in said aperture, said means comprising a notch in said shank for receiving a portion of a surface surrounding said washer aperture therein in a manner to preclude relative movement between said shank and said aperture, whereby said washer underlyingly supports a portion of said insulation below said roof and adjacent said purlin.

12. The apparatus as claimed in 11 wherein said shank member comprises a pair of side-by-side prong elements positioned in a normally spaced apart relationship therebetween and presenting a width greater than the width of said aperture, said prong elements being yieldably responsive in a first direction to reduce said width to allow for insertion of said prongs into said aperture and capture of said surrounding surface in said notch located in at least one of said prong elements.

13. The apparatus as claimed in 12 wherein said notch allows said prong elements to return towards said normal relationship subsequent to said capture of said surrounding surface therein.

14. The apparatus as claimed in 11 wherein said washer comprises:

a base plate;

a cone extending from said base plate and having said central aperture therein, said shank being received within said cone to preclude projection of said shank beyond said base plate of said washer.

15. The apparatus as claimed in 14 wherein said washer further comprises a plurality of upstanding teeth members projecting from said base plate with at least one of said teeth engaging said insulation whereby to preclude separation of said washer therefrom.

16. An insulation system comprising:

a plurality of insulation units for attachment to a roof-supporting framework;

a plurality of insulation fasteners for attaching said insulation units to said framework comprising:

a shank member having a free end;

means for attaching said shank member to said framework in a manner to extend said shank away from said roof and across a portion of at least one of said insulation units upon placemcnt of the same adjacent said framework;

a support washer having a shank receiving aperture therein, said support washer positioned adjacent a surface of said at least one of said insulation units opposite said framework for insertion of said free end of said shank in said aperture with said portion of said insulation unit supported between said washer and said purlin; and means for connecting each shank to each washer in a manner to maintain said supported portion of said insulation unit between said framework and said washer, said plurality of fasteners supports said plurality of insulation units adjacent said framework whereby to present said insulation system.

17. The apparatus as claimed in claim 16 wherein said plurality of fasteners are attached to said framework in a manner to position said plurality of insulation units in adjacent relationships therebetween whereby to cover said framework by means of said adjacent insulation units.

18. The apparatus as claimed in claim 17 further comprising a vapor barrier tape covering the extent of joints formed at the juncture of said adjacent insulation units whereby to preclude passage of moisture therethrough.

19. The apparatus as claimed in claim 18 wherein a vapor barrier tape covers each of said washers to preclude passage of moisture through said washer and into said insulation unit.

20. The apparatus as claimed in claim 19 wherein said washer comprises:

a base plate;

a cone extending from said base plate and having said shank receiving aperture therein, said shank being received within said cone to preclude projection of said shank beyond said base plate of said washer and through said vapor barrier tape covering said washer.

21. The apparatus as claimed in claim 18 wherein a portion of said plurality of fasteners has said shank extending through said joints with said associated support washer spanning said joint whereupon said connection of said washer to said shank sandwiches a portion of each of said adjacent insulation units forming said joint between said framework and said washer.

22. The apparatus as claimed in claim 21 wherein said insulation system further comprises insulation placed atop said insulation units and between said framework and said roof whereby to increase the insulating efficiency of said system.

23. The apparatus as claimed in claim 16 wherein said connecting means comprises a notch in said shank, said notch receiving a portion of a surface surrounding said aperture therein to preclude relative movement between said shank and said aperture of said washer.

24. The apparatus as claimed in claim 23 wherein said shank comprises a pair of side-by-side prong elements positioned in a normally spaced apart relationship therebetween and presenting a width greater than the width of said aperture, said prong elements being yieldably responsive in a first direction to reduce said width to allow for insertion of said prongs into said aperture and capture of said surrounding surface in said notch located in at least one of said prong elements.

25. The apparatus as claimed in claim 24 wherein said notch allows said prong elements to return towards said normal relationship subsequent to said capture of said surrounding surface therein.

26. The apparatus as claimed in claim 16 wherein said washer further comprises a plurality of upstanding teeth projecting from said washer for engagement with said insulation unit.

* * * * *